US008465398B2

(12) United States Patent
Lee et al.

(10) Patent No.: US 8,465,398 B2
(45) Date of Patent: Jun. 18, 2013

(54) ELLIPTICAL EXERCISE APPARATUS

(75) Inventors: Sunny Lee, Nan-Tou Hsien (TW); Simon Chao, Nan-Tou Hsien (TW)

(73) Assignee: Superweigh Enterprise Co., Ltd., Nan-Tou Hsien (TW)

( * ) Notice: Subject to any disclaimer, the term of this patent is extended or adjusted under 35 U.S.C. 154(b) by 371 days.

(21) Appl. No.: 12/902,386

(22) Filed: Oct. 12, 2010

(65) Prior Publication Data

US 2012/0088636 A1 Apr. 12, 2012

(51) Int. Cl.
*A63B 69/16* (2006.01)

(52) U.S. Cl.
USPC ..... 482/52; 482/62

(58) Field of Classification Search
USPC ..... 482/51–52, 54, 57, 79–80, 148
See application file for complete search history.

(56) References Cited

U.S. PATENT DOCUMENTS

| | | | | |
|---|---|---|---|---|
| 3,024,023 | A * | 3/1962 | Steller | 482/62 |
| 3,432,164 | A * | 3/1969 | Deeks | 482/51 |
| 6,645,125 | B1 * | 11/2003 | Stearns et al. | 482/52 |
| 6,846,273 | B1 * | 1/2005 | Stearns et al. | 482/52 |
| 7,163,492 | B1 * | 1/2007 | Sotiriades | 482/51 |
| 2005/0227824 | A1 * | 10/2005 | Wu et al. | 482/62 |

* cited by examiner

*Primary Examiner* — Stephen Crow
(74) *Attorney, Agent, or Firm* — Husch Blackwell LLP

(57) ABSTRACT

An elliptical exercise apparatus includes a frame unit having a base frame and an upstanding frame, two crank arms, and an adjustment unit including a motor, a slide mounted movably on the upstanding frame, and a threaded rod connected threadedly to the slide and connected drivenly to the motor. Two swing units are disposed respectively on left and right sides of the frame unit and each includes a handle movable along with the slide, a link rod connected pivotally between an intermediate portion of the handle and one of the crank arms, a pivot arm connected pivotally to the link rod, and a pedal rod connected pivotally between a lower connecting portion of the handle and the pivot arm. The slide moves upwardly or downwardly along the upstanding frame when the motor is activated to adjust the position of the handle relative to the upstanding frame.

16 Claims, 11 Drawing Sheets

ELLIPTICAL EXERCISE APPARATUS

BACKGROUND OF THE INVENTION

1. Field of the Invention

The invention relates to an exercise apparatus, and more particularly to an elliptical exercise apparatus.

2. Description of the Related Art

Referring to FIG. 1, a conventional elliptical exercise apparatus includes a frame unit 1, a crank wheel unit 2 mounted on the frame unit 1 and that has two crank arms 201, and two swing units 3 disposed respectively on left and right sides of the frame unit 1. Each swing unit 3 includes a handle 301 connected pivotally to the frame unit 1, a pedal rod 302 connected pivotally to and disposed between a bottom end of the handle 301 and one of the crank arms 201, and a foot plate 303 fixed to a central portion of the pedal rod 302. Through such a connection, the user's feet can travel along an elliptical path during exercise.

However, since the foot plates 303 can only travel along a fixed elliptical path, only a specific muscle group of the user can be exercised. Further, since the pedal rod 302 of each swing unit 3 has front and rear ends connected pivotally and respectively to the handle 301 and one of the crank arms 201, the stride length of the pedal rod 302 is limited by the length of the respective crank arm 201. Moreover, since the foot plates 303 are fixed respectively to the pedal rods 302 of the swing units 3, the foot plates 303 can only move simultaneously with the pedal rods 302. Thus, even if the crank arms 201 are spaced apart from each other by an angle of 180°, the largest stride length that each foot plate 303 can travel will not exceed the distance between ends of the crank arms 201 (that is, the stride length is equal to about the sum of the lengths of the crank arms 201). This limits the extent of the stride length of the user's feet and negatively affects the user's exercise.

SUMMARY OF THE INVENTION

Therefore, the object of the present invention is to provide an elliptical exercise apparatus that can permit adjustment of the size of an elliptical path traveled by its foot plates and can increase the stride length of the user's feet.

According to one aspect of this invention, an elliptical exercise apparatus comprises a frame unit, a crank wheel unit, an adjustment unit, and two swing units. The frame unit includes a base frame and an upstanding frame. The crank wheel unit is disposed on the base frame, and includes two crank arms. The adjustment unit includes a motor mounted on the frame unit, a slide mounted on the upstanding frame and movable upwardly and downwardly relative to the upstanding frame, and a threaded rod connected threadedly to the slide and connected drivingly to the motor to move the slide. The two swing units are disposed respectively on left and right sides of the frame unit. Each swing unit includes a handle connected pivotally to and movable along with the slide, a link rod connected pivotally to the handle and one of the crank arms, a pivot arm connected pivotally to the link rod, and a pedal rod connected pivotally to the handle and the pivot arm. The handle has an upper connecting portion connected pivotally to the slide, a lower connecting portion opposite to the upper connecting portion, and an intermediate portion connected between the upper and lower connecting portions. The link rod has two opposite ends connected pivotally and respectively to the intermediate portion of the handle and one of the crank arms. The pedal rod has two opposite ends connected pivotally and respectively to the lower connecting portion of the handle and the pivot arm. The slide moves upward or downward along the upstanding frame when the motor is activated to adjust the position of the handle relative to the upstanding frame.

According to another aspect of this invention, an elliptical exercise apparatus comprises a frame unit, a crank wheel unit, and two swing units. The frame unit includes abase frame and an upstanding frame. The crank wheel unit is disposed on the base frame, and includes two crank arms. The two swing units are disposed respectively on left and right sides of the frame unit. Each swing unit includes a handle connected pivotally to the upstanding frame, a link rod connected pivotally to the handle and one of the crank arms, a pivot arm connected pivotally to the link rod, and a pedal rod connected pivotally to the handle and the pivot arm. The handle has an upper connecting portion connected pivotally to the upstanding frame, a lower connecting portion opposite to the upper connecting portion, and an intermediate portion connected between the upper and lower connecting portions. The link rod has two opposite ends connected pivotally and respectively to the intermediate portion of the handle and one of the crank arms. The pedal rod has two opposite ends connected pivotally and respectively to the lower connecting portion of the handle and the pivot arm.

According to still another aspect of this invention, an elliptical exercise apparatus comprises a frame unit, a crank wheel unit, an adjustment unit, and two swing units. The frame unit includes a base frame and an upstanding frame. The crank wheel unit is disposed on the base frame, and includes two crank arms. The adjustment unit includes a motor mounted on the frame unit, a slide mounted on the upstanding frame and movable upwardly and downwardly relative to the upstanding frame, and a threaded rod connected threadedly to the slide and connected drivenly to the motor to move the slide. The two swing units are disposed respectively on left and right sides of the frame unit. Each swing unit includes a handle connected pivotally to and movable along with the slide, and a pedal rod connected pivotally to the handle and one of the crank arms. The slide moves upwardly or downwardly along the upstanding frame when the motor is activated to adjust the position of the handle relative to the upstanding frame.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
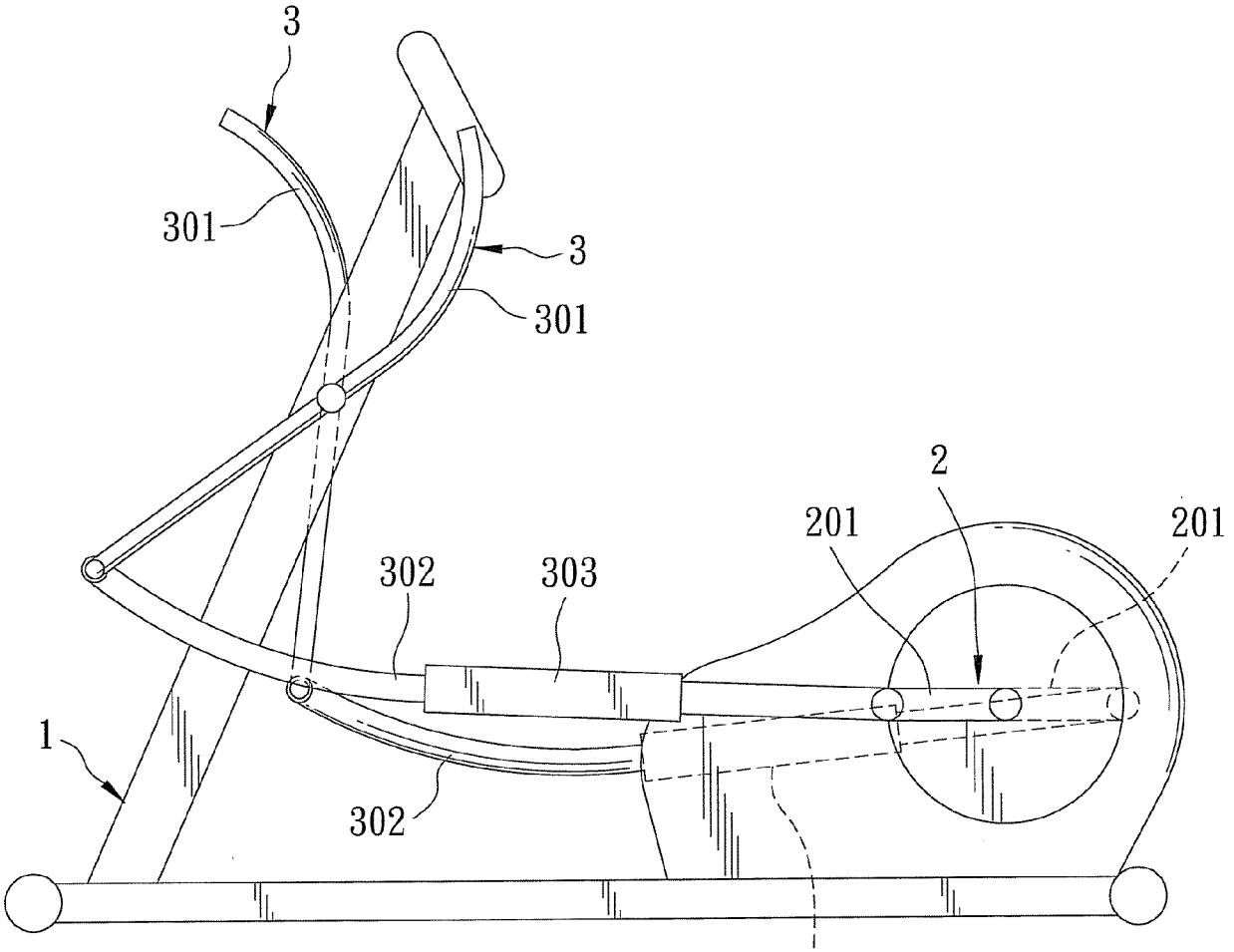
FIG. 1 PRIOR ART
FIG. 1 is a schematic side view of a conventional elliptical exercise apparatus.
Figure 2:
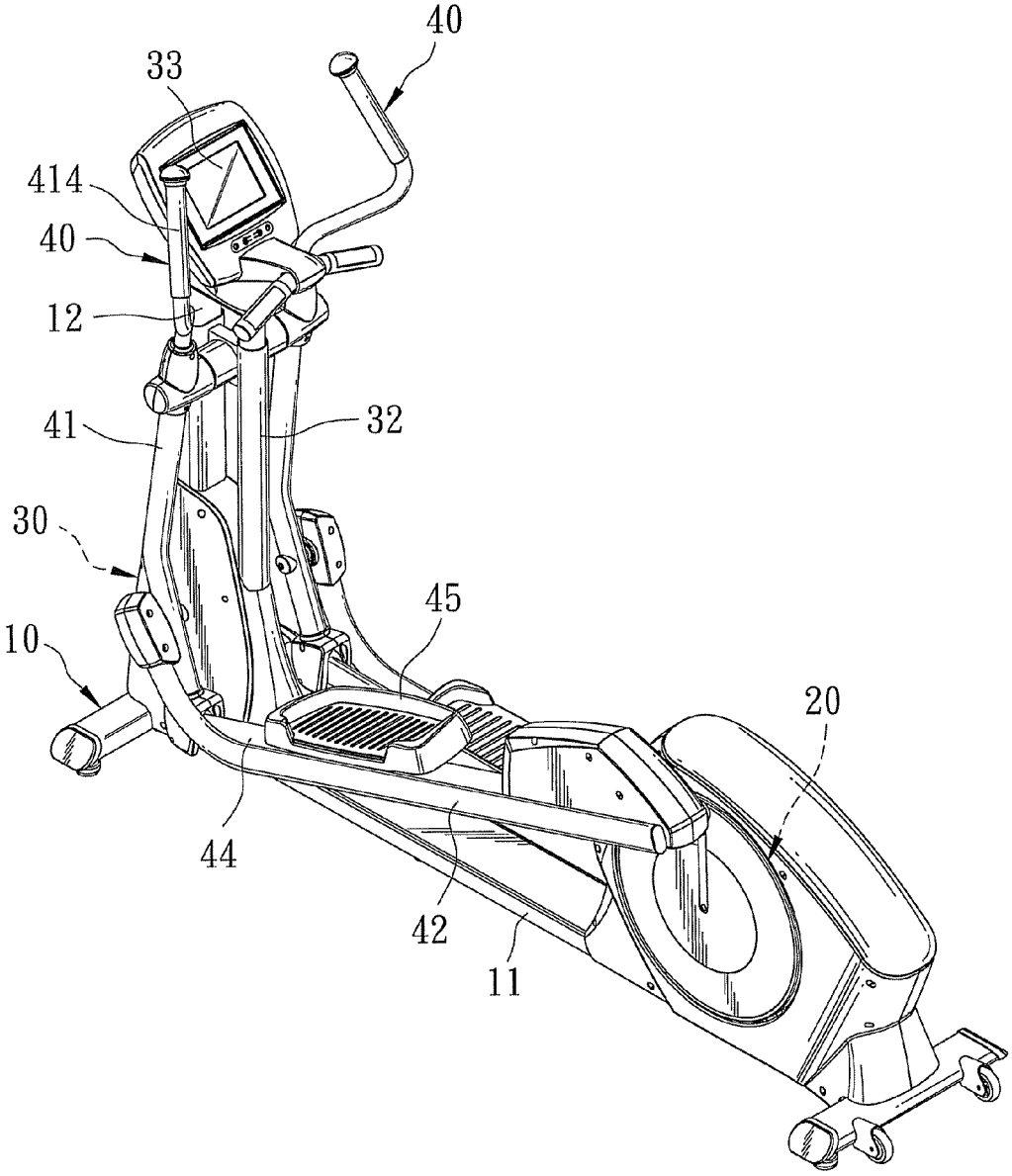
FIG. 2 is a perspective view of an elliptical exercise apparatus according to the first preferred embodiment of the present invention.

Before the present invention is described in greater detail, it should be noted that the same reference numerals have been used to denote like elements throughout the specification.

Referring to FIGS. 2 to 10, an elliptical exercise apparatus according to the first preferred embodiment of the present invention is shown to comprise a frame unit 10, a crank wheel unit 20, an adjustment unit 30, and two swing units 40.

The frame unit 10 includes a base frame 11, a first upstanding frame 12 extending upwardly from a front end of the base frame 11, and a second upstanding frame 112 extending upwardly from a rear end of the base frame 11. The upstanding frame 12 includes two upstanding guide rods 121 spaced apart from each other in a front-rear direction.

The crank wheel unit 20 is disposed on the base frame 11, and includes a crank wheel 231 mounted rotatably on the second upstanding frame 112, and two crank arms 21 connected rotatably and respectively to left and right sides of a crank shaft of the crank wheel 231.

A resisting unit includes a resistance wheel 22 mounted rotatably on the rear end of the base frame 11 to provide resistance to rotation of the crank wheel 231. A drive mechanism 23 is provided on the rear end of the base frame 11, and includes a belt pulley 232 disposed below the crank wheel 231, a first belt 233 interconnecting the crank wheel 231 and the belt pulley 232, and a second belt 234 interconnecting the belt pulley 232 and the resistance wheel 22. The resistance wheel 22 is driven by the crank arms 21 to rotate through the drive mechanism 23.

The adjustment unit 30 includes a motor 31, a slide 32, a threaded rod 311, and a console panel 33. The motor 31 is mounted on the front end of the base frame 11. The slide 32 includes two tubular sleeves 321 sleeved respectively and slidably on the upstanding guide rods 121, a bridge member 322 interconnecting top ends of the tubular sleeves 321, and a substantially T-shaped female thread member 323 connected between bottom ends of the tubular sleeves 321. The threaded rod 311 is connected drivingly to the motor 31. In this embodiment, the threaded rod 311 extends upwardly between the tubular sleeves 321. The female thread member 323 is engaged threadedly and movably to the threaded rod 311. The console panel 33 is disposed on top ends of the upstanding guide rods 121, and is connected electrically to the motor 31.

The swing units 40 are disposed respectively on left and right sides of the frame unit 10. Each swing unit 40 includes a handle 41, a link rod 42, a pivot arm 43, a pedal rod 44, and a foot plate 45. The handle 41 has an upper connecting portion 411 connected pivotally to the bridge member 322, a grip portion 414 extending upwardly from the upper connecting portion 411, a lower connecting portion 412 opposite to the grip portion 414, and an intermediate portion 413 connected between the upper and lower connecting portions 411, 412. The link rod 42 has a front end 421 connected pivotally to the intermediate portion 413 of the handle 41, a rear end 422 connected pivotally to one of the crank arms 21, and a hanging portion 423 disposed on and extending forward and inclinedly from the rear end 422. The pivot arm 43 has a bottom end, and a top end connected pivotally to a front end of the hanging portion 423. The pedal rod 44 has a front end 441 connected pivotally to the lower connecting portion 412 of the handle 41, and a rear end 442 connected pivotally to the bottom end of the pivot arm 43. The foot plate 45 is disposed on the pedal rod 44 between the front and rear ends 441, 442.

When the user's feet stands on the respective foot plates 45 of the swing units 40 with his/her hands grasping the grip portions 414 of the respective handles 41 of the swing units 40, and starts exercising, the pedal rods 44 of the swing units 40 can move the foot plates 45 and the user's feet to travel along an elliptical path.

Figure 7:
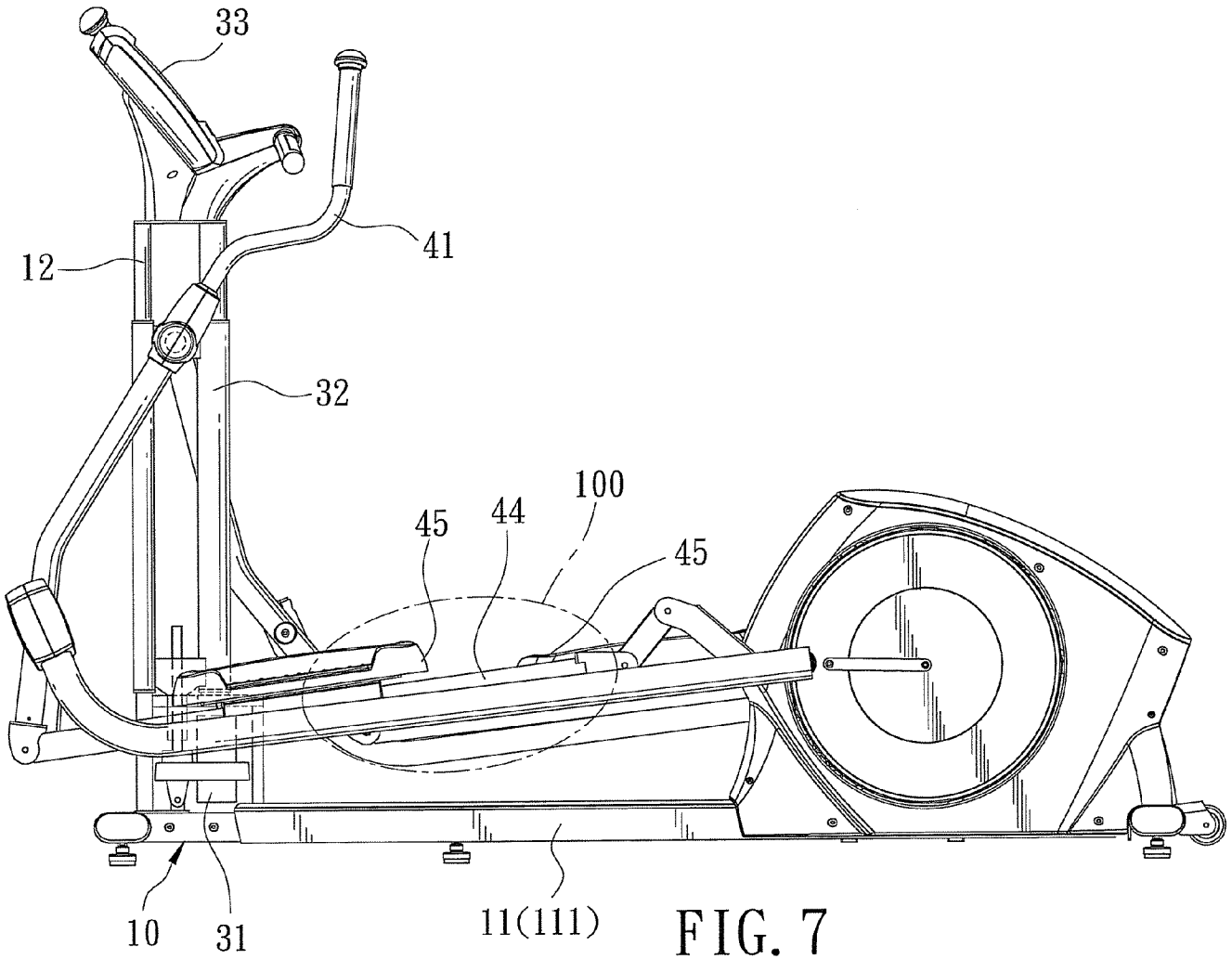
FIG. 7 is a schematic left side view of FIG. 2, illustrating a foot plate traveling along an elliptical path that has a largest inclination relative to a base frame.
Figure 8:
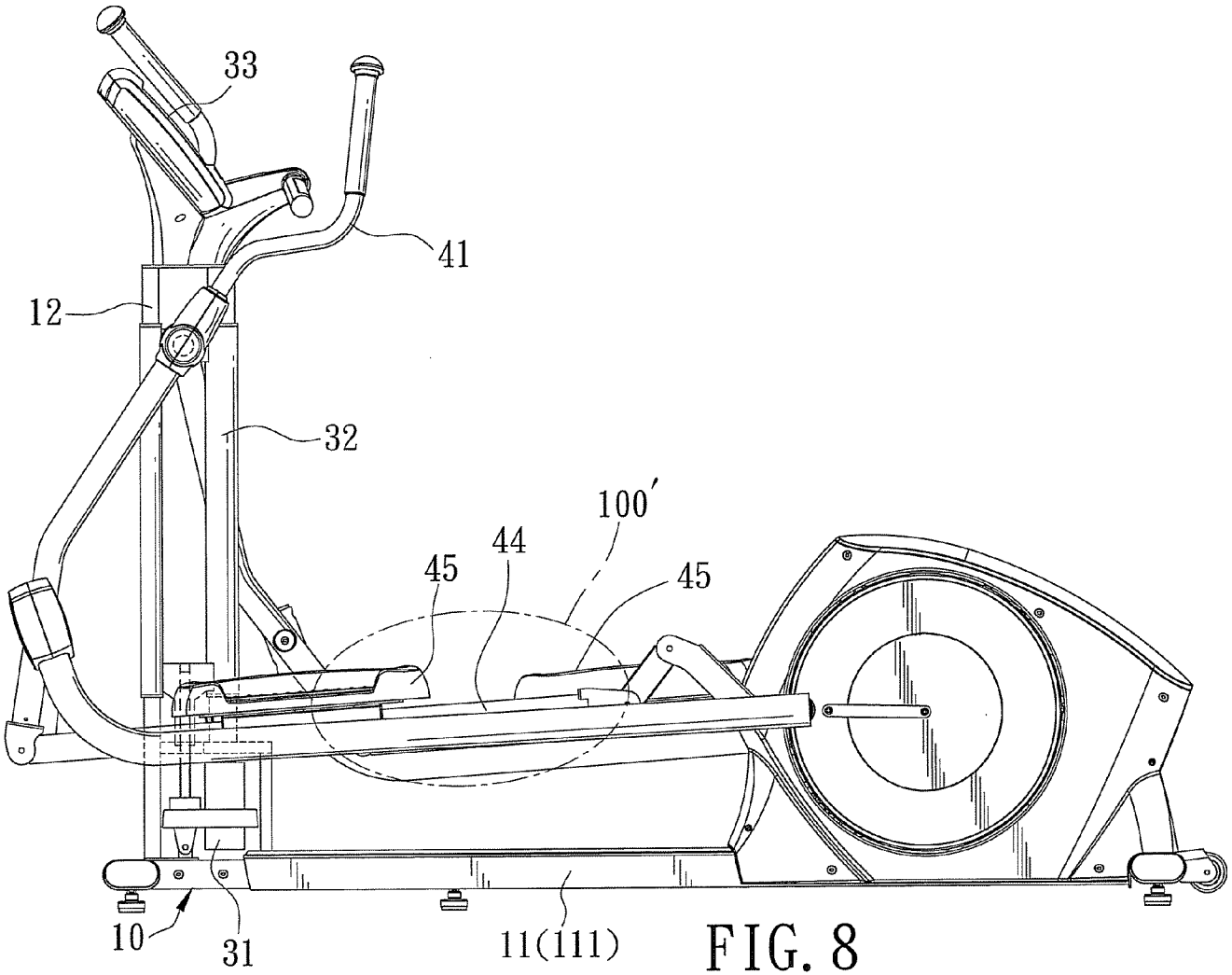
FIG. 8 is a view similar to FIG. 7, but illustrating the foot plate traveling along an elliptical path that has an inclination smaller than that of FIG. 7.
Figure 9:
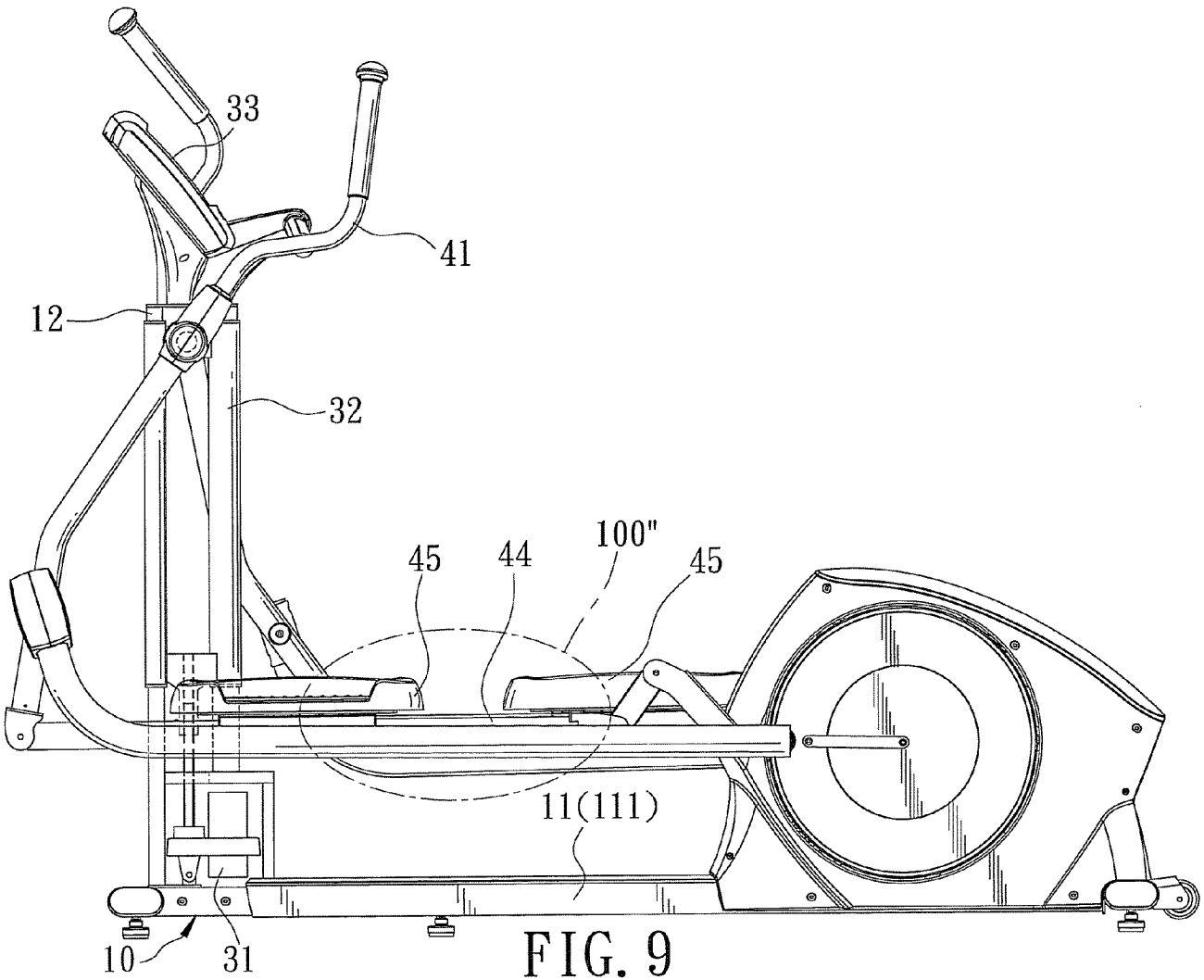
FIG. 9 is a view similar to FIG. 8, but illustrating the foot plate traveling along an elliptical path that has the smallest inclination relative to the base frame.
Figure 10:
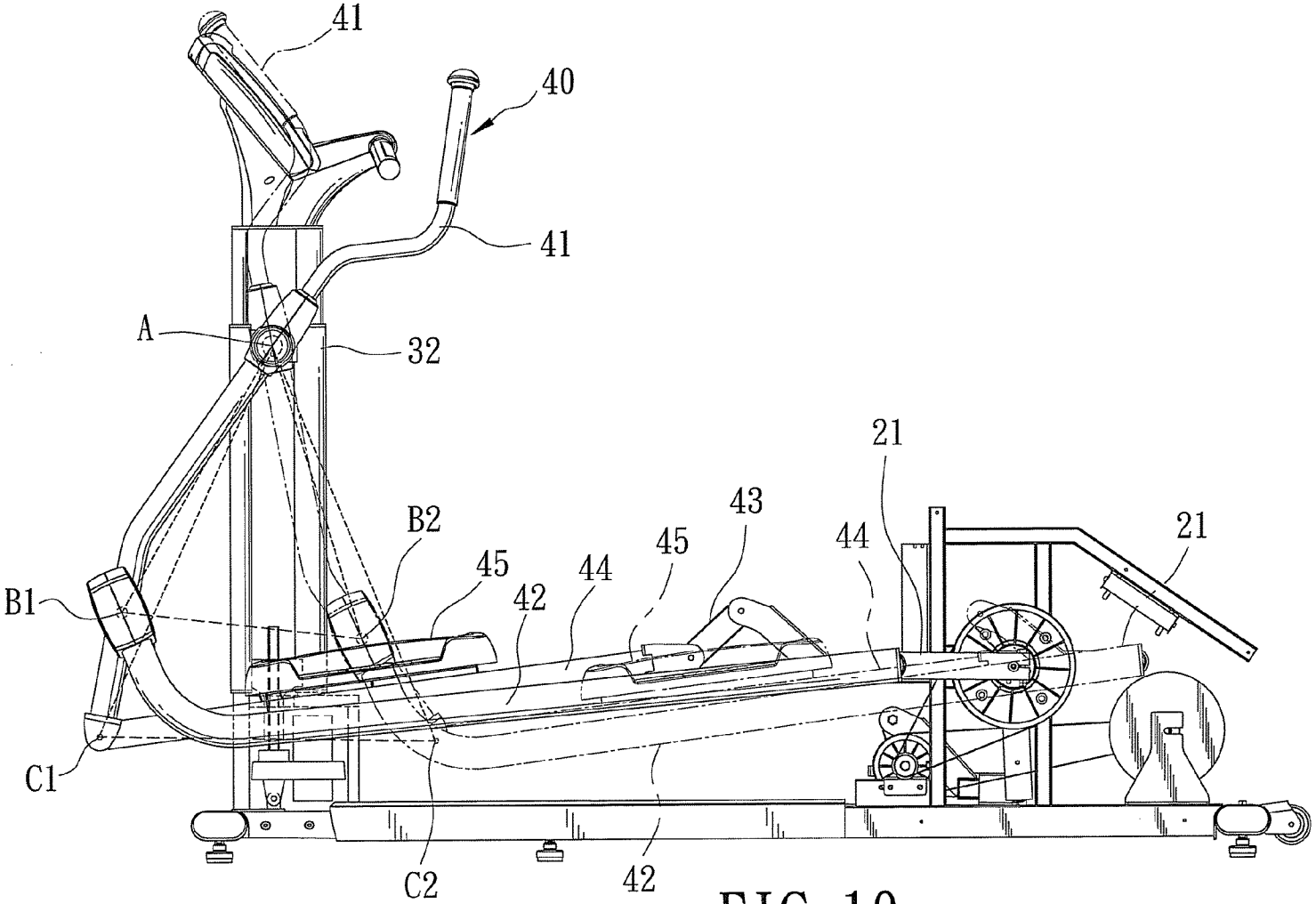
FIG. 10 is a schematic side view of the first preferred embodiment, illustrating forward and rearward motion of swing units of the first preferred embodiment.

With reference to FIGS. 7, 8, and 9, the user can control the motor 31 through the console panel 33 to actuate the threaded rod 311 to rotate so that the female thread member 323 can move threadedly upward or downward along the length of the threaded rod 311. The female thread member 323, in turn, moves the tubular sleeves 321 upward and downward along the respective upstanding guide rods 121, so that the position of the handles 41 relative to the first upstanding frame 12 can be adjusted. This, in turn, results in adjusting an inclination degree of each pedal rod 44 of the swing units 40 relative to the base frame 11, so that the pedal rods 44 can move the foot plates 45 along an elliptical path 100 that is also inclined relative to the base frame 11.

With reference to FIG. 7, when the slide 32 moves the handles 41 downward along the upstanding guide rods 121 to a lowest position, the pedal rods 44 are inclined with respect to the base frame 11 such that the rear ends of the pedal rods 44 are disposed higher than their respective front ends. At this time, the pedal rods 44 can move the foot plates 45 to travel along an elliptical path that has a largest inclination degree relative to the base frame 11.

With reference to FIG. 8, when the slide 32 moves the handles 41 upward along the upstanding guide rods 121, the pedal rods 44 are inclined with respect to the base frame 11 such that the rear ends of the pedal rods 44 are disposed higher than their respective front ends. At this time, the pedal rods 44 can move the foot plates 45 to travel along an elliptical path 100' that has an inclination degree smaller than that of the elliptical path 100 shown in FIG. 7.

With reference to FIG. 9, when the slide 32 moves the handles 41 upward along the upstanding guide rods 121 to a highest position, the pedal rods 44 are substantially parallel to the base frame 11, and can move the foot plates 45 to travel along a substantially horizontal elliptical path 100" that has the smallest inclination degree compared to that of the elliptical paths 100 and 100' shown in FIGS. 7 and 8.

It is worth mentioning that, in this embodiment, the length of the upstanding guide rods 121 and the length of the threaded rod 311 can be extended according to the user's requirements. When the slide 32 moves the handles 41 upward along the upstanding guide rods 121 to a highest position, the pedal rods 44 may be inclined relative to the base frame 11 such that the front ends of the pedal rods 44 are higher than their respective rear ends. At this time, the pedal rods 44 can move the foot plates 45 to travel along an elliptical path (not shown) that has an inclination degree relative to the base frame 11 and that has a front side higher than a rear side.

By varying the inclination degree of the elliptical path traveled by the foot plates 45, the user can exercise different muscle groups of his/her body during exercise. For example, the elliptical path 100 shown in FIG. 7 has the largest inclination degree, which permits the user to focus on exercising the muscle groups of his/her lower legs. In contrast, the elliptical path 100" shown in FIG. 9 has the smallest inclination degree, which permits the user to exercise not only the muscle groups of his/her lower legs, but also the muscle groups of his/her upper legs and buttocks.

Figure 3:
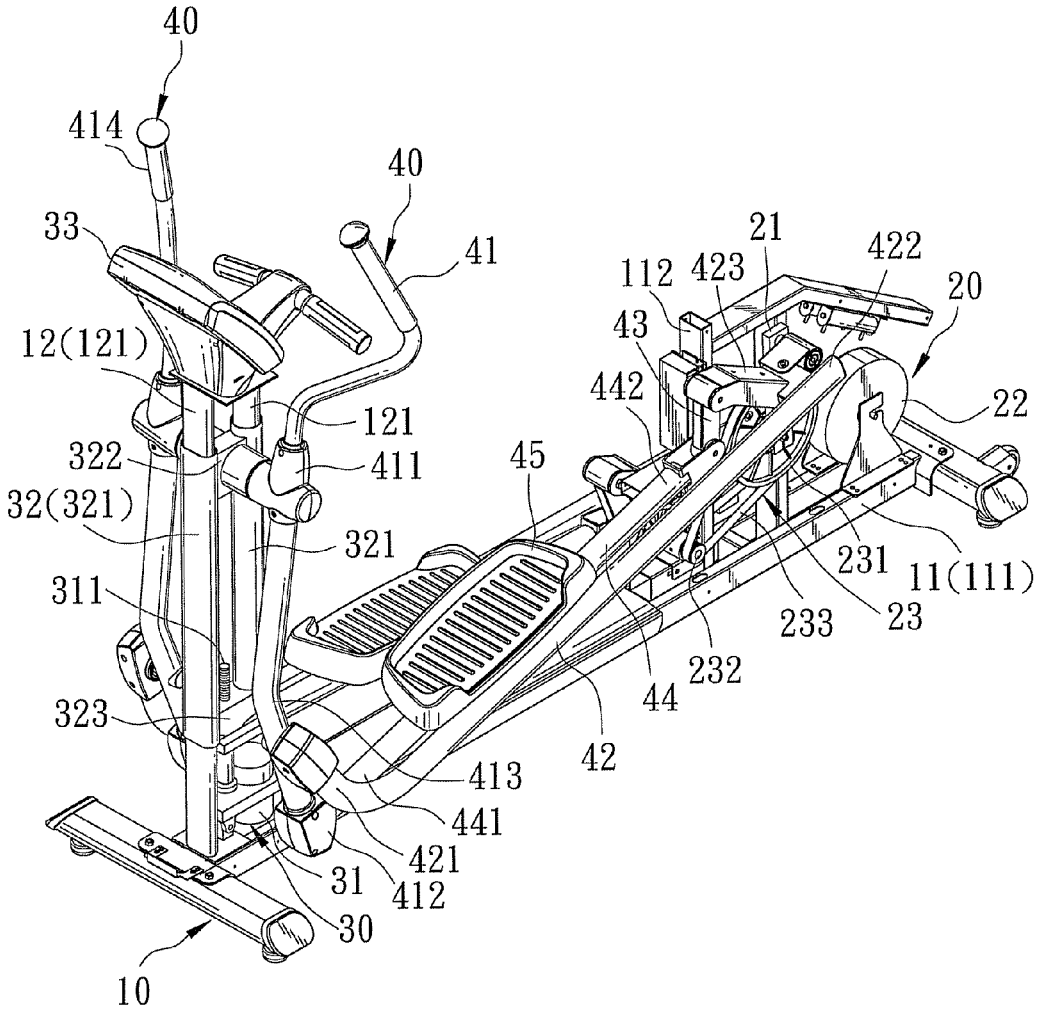
FIG. 3 is another perspective view of the first preferred embodiment, but without a housing.
Figure 4:
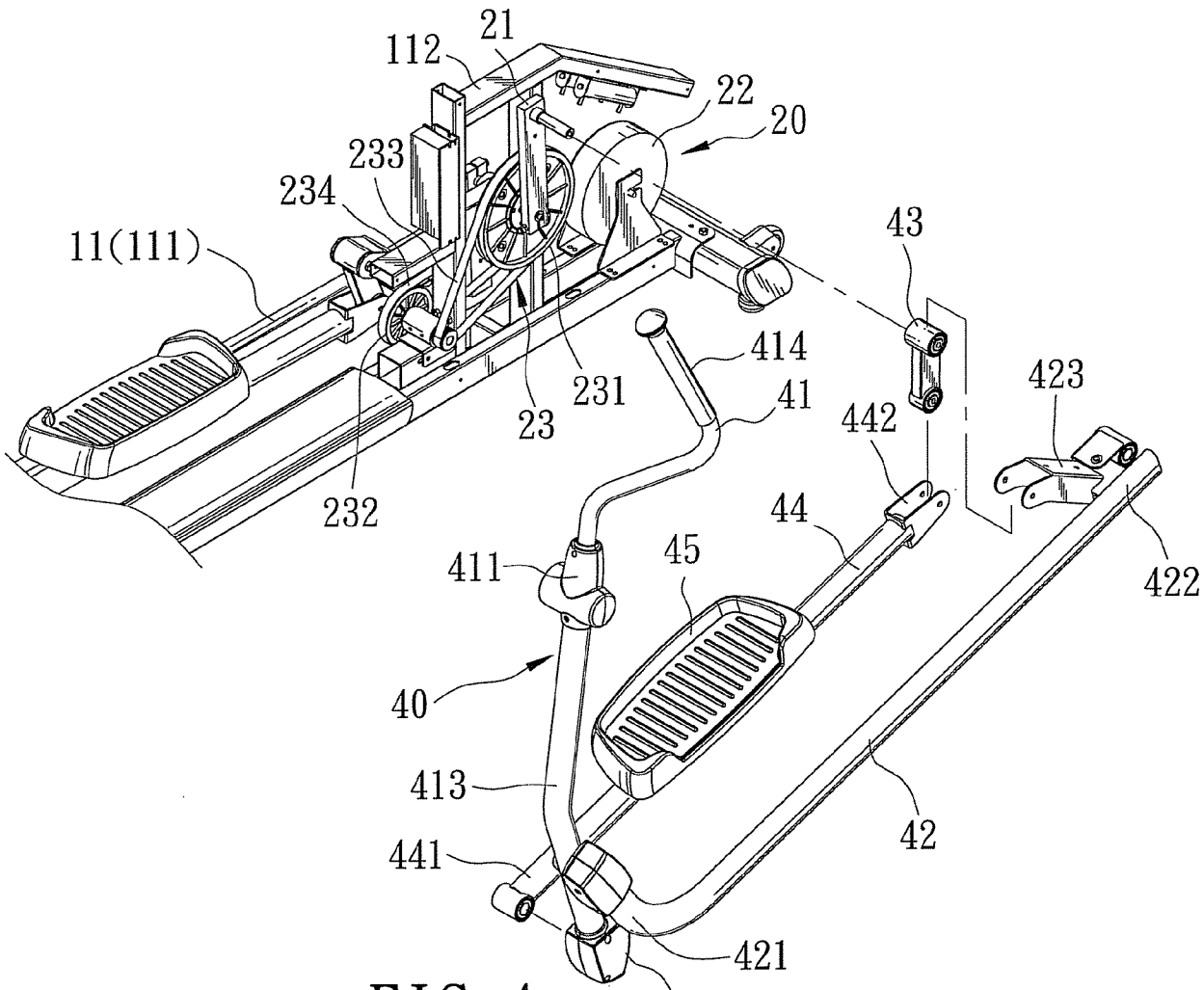
FIG. 4 is a fragmentary partial exploded perspective view of the first preferred embodiment.
Figure 5:
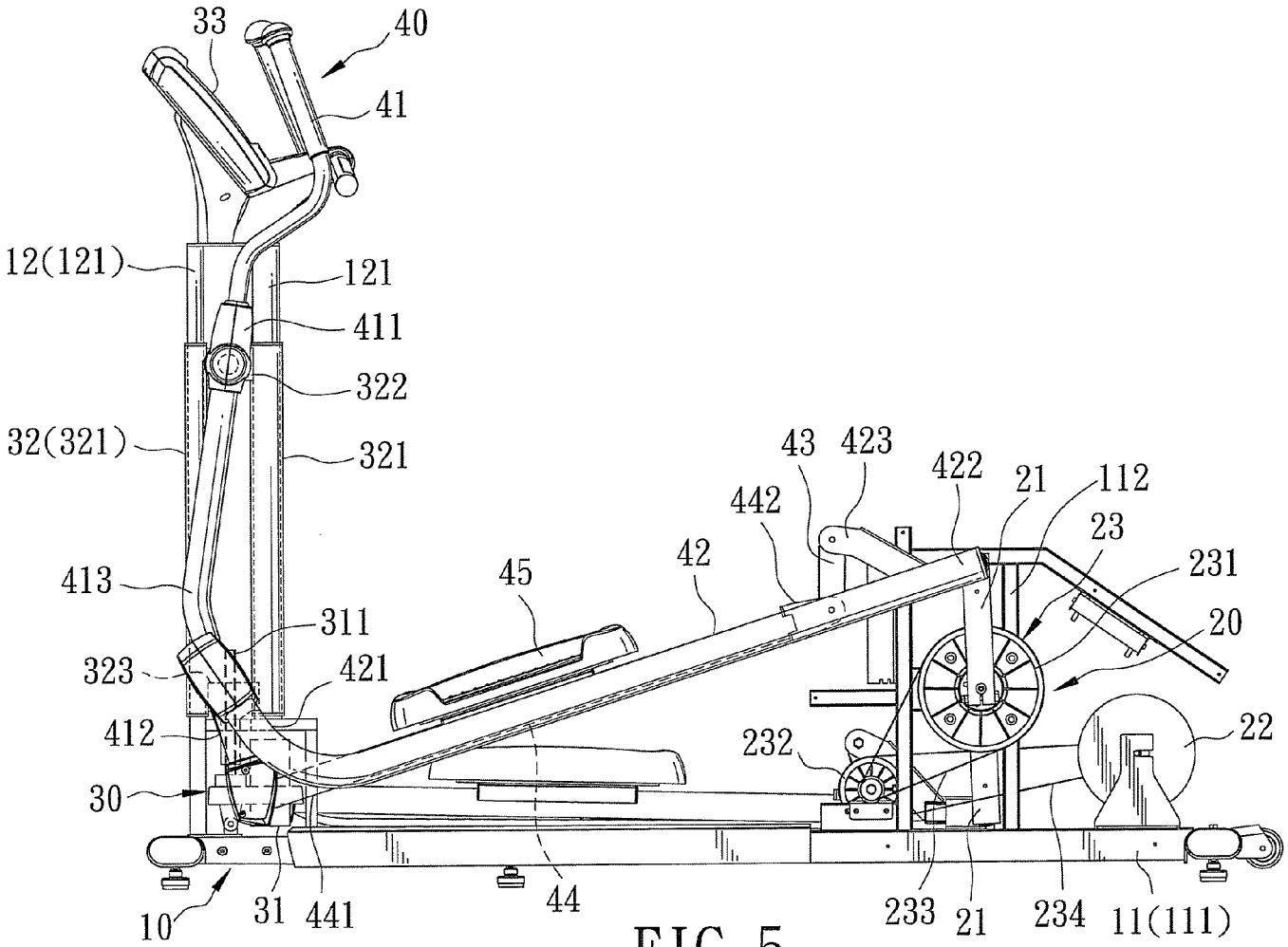
FIG. 5 is a schematic left side view of FIG. 3.
Figure 6:
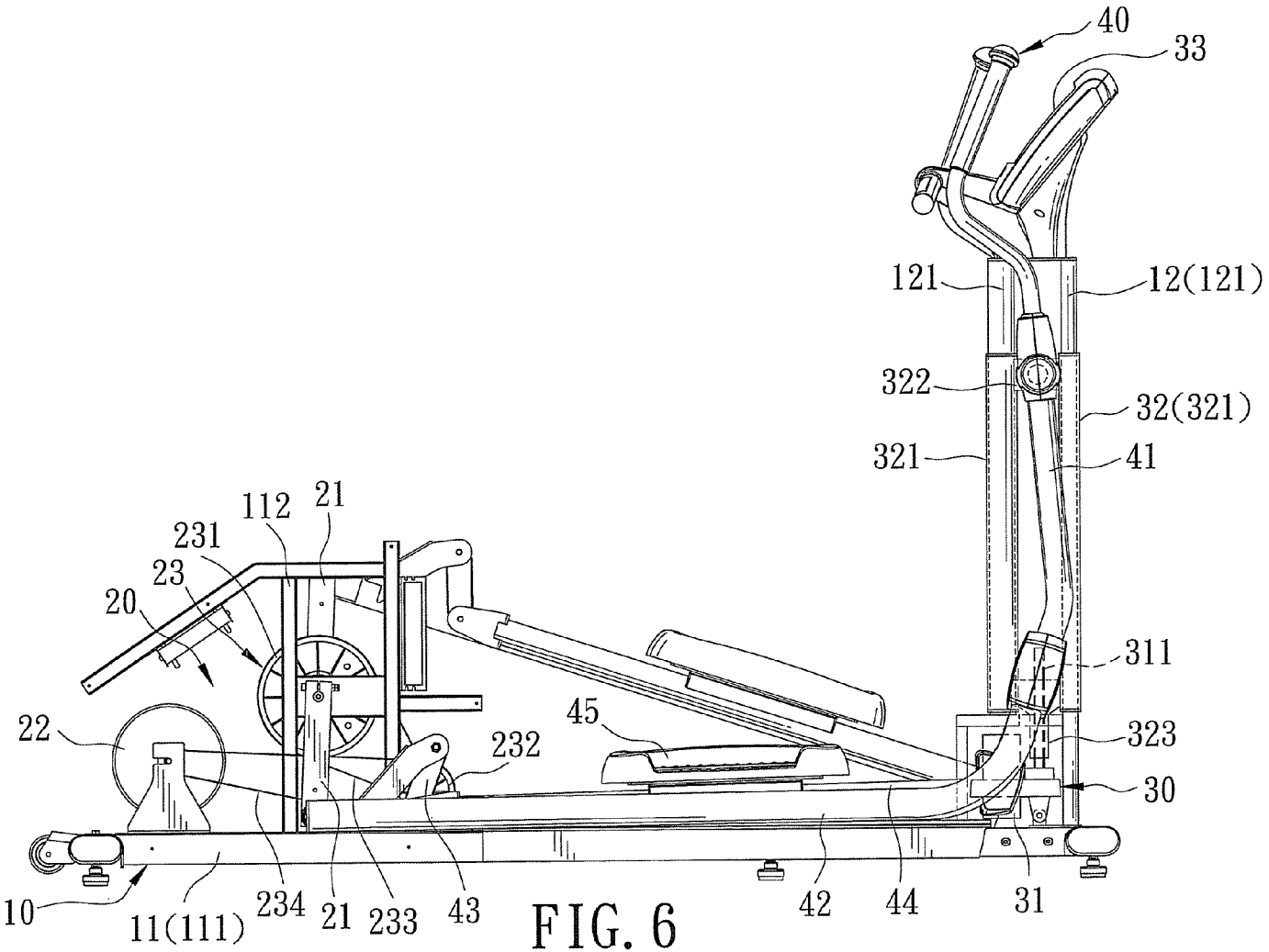
FIG. 6 is a schematic right side view of FIG. 3.

Further, with reference to FIG. 3, since the pedal rod 44 of each swing unit 40 is connected pivotally to and disposed between the handle 41 and the pivot arm 43, and is not directly connected to one of the crank arms 21, and since the pivot arm 43 can pivot relative to the link rod 42, the distance of the forward and rearward motion of the pedal plate 45 moved by the pedal rod 44 will not be limited by the length of the crank arms 21. It is the distance of the forward and rearward motion of the link rod 42 that is limited by the length of the crank arms 21 since the link rod 42 is connected to the respective crank arm 21. Moreover, with reference to FIG. 10, the distance of the forward and rearward motion of the pedal plate 45 is larger than the distance of the forward and rearward motion of the link rod 42.

Referring once again to FIG. 10, the left side of the swing unit 40 pivoting to the most forward position and the most rearward position is described. A pivot connecting point of the handle 41 and the slide 32 is defined as point A, a pivot connecting point of the handle 41 and the link rod 42 is defined as point B1 and point B2, a pivot connecting point of the handle 41 and the pedal rod 44 is defined as point C1 and point C2, and triangle AB1B2 is similar to triangle AC1C2. From the proportion relation of similar triangles, it is apparent that a ratio of line C1C2 (that is, the largest distance of the forward and rearward motion of the pedal rod 44) and line B1B2 (that is, the largest distance of the forward and rearward motion of the link rod 42) is equal to a ratio of line AC1 and line AB1. Although the largest distance (that is, line B1B2) of the forward and rearward motion of the link rod 42 is limited by the length of the crank arms 21 (line B1B2 is equal to the sum of the lengths of two crank arms 21), since line AC1 is longer than line AB1, the largest distance (that is, line C1C2) of the forward and rearward motion of the foot plate 45 is larger than line B1B2. That is, line C1C2 is larger than the sum of the lengths of the two crank arms 21. From this, it is apparent that the present invention can increase the stride length of the user's feet during exercise.

From the aforesaid description, the advantages of the present invention can be summarized as follows:

1. The adjustment unit 30 can actuate the slide 32 to move the handle 41 upward or downward along the upstanding frame 12, so that the user can adjust an inclination degree of the elliptical path to be traveled by the foot plates 45 according to his/her requirements. As such, by varying the inclination degree of the elliptical path, the user can train different muscle groups during his/her exercise.

2. The pedal rod 44 is connected pivotally to and disposed between the handle 41 and the pivot arm 43, and is not directly connected to one of the crank arms 21. Further, the pivot arm 43 is pivotable relative to the link rod 42. Hence, the distance of the forward or rearward motion of the pedal rod 44 is not limited by the length of the crank arms 21. In comparison with conventional techniques, the present invention can effectively increase the stride length of the user's feet during his/her exercise.

Alternatively, each swing unit 40 of the present invention may be dispensed with the link rod 42 and the pivot arm 43. That is, each swing unit 40 may be similar to the swing unit 3 shown in FIG. 1, and only includes the handle 41, the pedal rod 44, and the foot plate 45. The rear end 442 of the pedal rod 44 is connected pivotally to one of the crank arms 21, so that the pedal rod 44 is connected pivotally to and disposed between the slide 32 and one of the crank arms 21. As such, the adjustment unit 30 can adjust the inclination degree of the elliptical path traveled by the foot plate 45.

Figure 11:
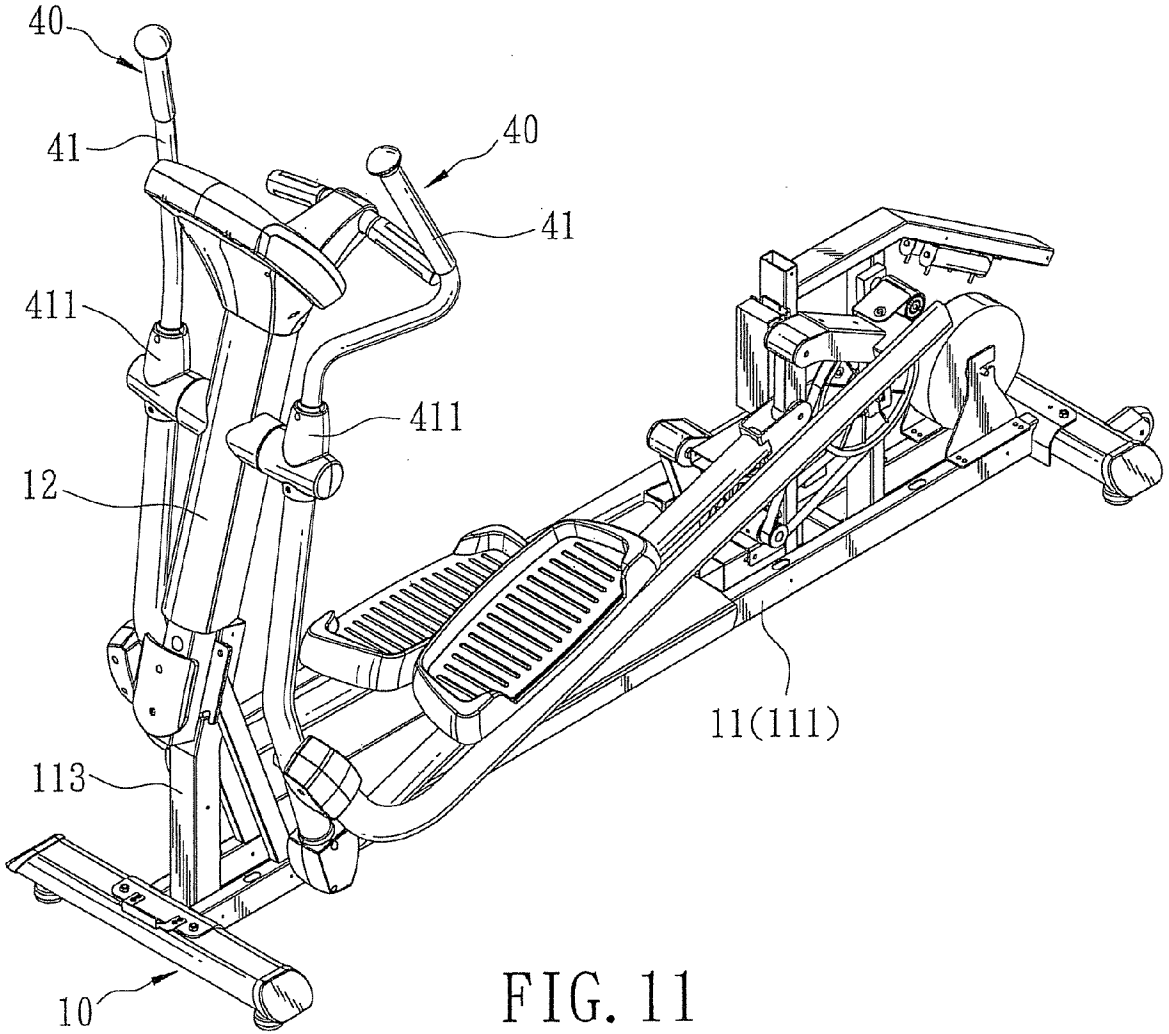
FIG. 11 is a perspective view of an elliptical exercise apparatus according to the second preferred embodiment of the present invention, but without a housing.

With reference to FIG. 11, an elliptical exercise apparatus according to the second preferred embodiment of the present invention is shown to be similar to the first preferred embodiment. However, in this embodiment, the adjustment unit 30 is dispensed with. The upper connecting portions 411 of the handles 41 of the swing units 40 are connected pivotally and respectively to the left and right sides of the first upstanding frame 12. Hence, the second preferred embodiment can similarly increase the stride length of the user's feet during exercise.

From the aforesaid description, it is apparent that the elliptical exercise apparatus of the present invention not only can provide adjustment of the position of the handles 41 relative to the first upstanding frame to obtain various inclination degrees of the elliptical path traveled by the foot plates 45 to suit a user's requirement, but also can increase the stride length of the user's feet during exercise. The object of the present invention can thus be realized.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An elliptical exercise apparatus comprising:

a frame unit including a base frame and a first upstanding frame;

a crank wheel unit disposed on said base frame and including two crank arms;

an adjustment unit including a motor mounted on said frame unit, a slide mounted on said first upstanding frame and movable upwardly and downwardly relative to said first upstanding frame, and a threaded rod connected threadedly to said slide and connected drivenly to said motor to move said slide; and two swing units disposed respectively on left and right sides of said frame unit, each of said swing units including a handle connected pivotally to and movable along with said slide, a link rod connected pivotally to said handle and one of said crank arms, a pivot arm connected pivotally to said link rod, and a pedal rod connected pivotally to said handle and said pivot arm, said handle having an upper connecting portion connected pivotally to said slide, a lower connecting portion opposite to said upper connecting portion, and an intermediate portion connected between said upper and lower connecting portions, said link rod having two opposite ends connected pivotally and respectively to said intermediate portion of said handle and one of said crank arms, said pedal rod having two opposite ends connected pivotally and respectively to said lower connecting portion of said handle and said pivot arm;

wherein said slide moves upwardly or downwardly along said first upstanding frame when said motor is activated to adjust the position of said handle relative to said first upstanding frame.

2. The elliptical exercise apparatus of claim 1, wherein said first upstanding frame extends upwardly from a front end of said base frame, and said motor is mounted on said front end of said base frame.

3. The elliptical exercise apparatus of claim 2, wherein said first upstanding frame includes two spaced-apart upstanding guide rods, said slide including two tubular sleeves sleeved respectively and slidably on said upstanding guide rods, a bridge member interconnecting top ends of said tubular sleeves, and a female thread member connected between bottom ends of said tubular sleeves, said threaded rod extending upwardly between said tubular sleeves, said female thread member being engaged threadedly and movably to said threaded rod, said upper connecting portion of said handle being connected pivotally to said bridge member.

4. The elliptical exercise apparatus of claim 2, further comprising a console panel disposed on a top end of said first upstanding frame and connected electrically to said motor.

5. The elliptical exercise apparatus of claim 2, wherein said frame unit further includes a second upstanding frame extending upwardly from a rear end of said base frame, said crank wheel unit further including a crank wheel mounted rotatably on said second upstanding frame, said crank arms being connected rotatably to said crank wheel, said elliptical exercise apparatus further comprising a resistance unit to provide resistance to rotation of said crank wheel.

6. The elliptical exercise apparatus of claim 1, wherein said link rod has a front end connected pivotally to said intermediate portion of said handle, a rear end connected pivotally to one of said crank arms, and a hanging portion disposed on and extending forward and inclinedly from said rear end of said link rod, said pivot arm having a bottom end, and a top end connected pivotally to a front end of said hanging portion, said pedal rod having a front end connected pivotally to said lower connecting portion of said handle, and a rear end connected pivotally to said bottom end of said pivot arm.

7. The elliptical exercise apparatus of claim 6, wherein each of said swing units further includes a foot plate disposed on said pedal rod between said front and rear ends thereof.

8. An elliptical exercise apparatus comprising:

a frame unit including a base frame and a first upstanding frame;

a crank wheel unit disposed on said base frame and including two crank arms; and two swing units disposed respectively on left and right sides of said frame unit, each of said swing units including a handle connected pivotally to said first upstanding frame, a link rod connected pivotally to said handle and one of said crank arms, a pivot arm connected pivotally to said link rod, and a pedal rod connected pivotally to said handle and said pivot arm, said handle having an upper connecting portion connected pivotally to said first upstanding frame, a lower connecting portion opposite to said upper connecting portion, and an intermediate portion connected between said upper and lower connecting portions, said link rod having two opposite ends connected pivotally and respectively to said intermediate portion of said handle and one of said crank arms, said pedal rod having two opposite ends connected pivotally and respectively to said lower connecting portion of said handle and said pivot arm.

9. The elliptical exercise apparatus of claim 8, wherein said first upstanding frame extends upwardly from a front end of said base frame.

10. The elliptical exercise apparatus of claim 9, wherein said frame unit further includes a second upstanding frame extending upwardly from a rear end of said base frame, said crank wheel unit further including a crank wheel mounted rotatably on said top frame portion, said crank arms being connected rotatably to said crank wheel, said elliptical exercise apparatus further comprising a resistance unit to provide resistance to rotation of said crank wheel.

11. The elliptical exercise apparatus of claim 8, wherein said link rod has a front end connected pivotally to said intermediate portion of said handle, a rear end connected pivotally to one of said crank arms, and a hanging portion disposed on and extending forward and inclinedly from said rear end of said link rod, said pivot arm having a bottom end, and a top end connected pivotally to a front end of said hanging portion, said pedal rod having a front end connected pivotally to said lower connecting portion of said handle, and a rear end connected pivotally to said bottom end of said pivot arm.

12. The elliptical exercise apparatus of claim 11, wherein each of said swing units further includes a foot plate disposed on said pedal rod between said front and rear ends thereof.

13. An elliptical exercise apparatus comprising:

a frame unit including a base frame and a first upstanding frame;

a crank wheel unit disposed on said base frame and including two crank arms;

an adjustment unit including a motor mounted on said frame unit, a slide mounted on said first upstanding frame and movable upwardly and downwardly relative to said first upstanding frame, and a threaded rod connected threadedly to said slide and connected drivenly to said motor to move said slide; and two swing units disposed respectively on left and right sides of said frame unit, each of said swing units including a handle connected pivotally to and movable along with said slide, and a pedal rod connected pivotally to said handle and one of said crank arms;

wherein said slide moves upwardly or downwardly along said first upstanding frame when said motor is activated to adjust the position of said handle relative to said first upstanding frame;

wherein said first upstanding frame extends upwardly from a front end of said base frame, and said motor is mounted on said front end of said base frame; and wherein said first upstanding frame includes two spaced-apart upstanding guide rods, said slide including two tubular sleeves sleeved respectively and slidably on said upstanding guide rods, a bridge member interconnecting top ends of said tubular sleeves, and a female thread member connected between bottom ends of said tubular sleeves, said threaded rod extending upwardly between said tubular sleeves, said female thread member being engaged threadedly and movably to said threaded rod, said upper connecting portion of said handle being connected pivotally to said bridge member.

14. The elliptical exercise apparatus of claim 13, further comprising a console panel disposed on a top end of said first upstanding frame and connected electrically to said motor.

15. The elliptical exercise apparatus of claim 13, wherein said frame unit further includes a second upstanding frame extending upwardly from a rear end of said base frame, said crank wheel unit further including a crank wheel mounted rotatably on said top frame portion, said crank arms being connected rotatably to said crank wheel, said elliptical exercise apparatus further comprising a resistance unit to provide resistance to rotation of said crank wheel.

16. The elliptical exercise apparatus of claim 13, wherein each of said swing units further includes a foot plate disposed on said pedal rod between two opposite ends thereof.

* * * * *